United States Patent [19]

Lisin et al.

[11] 4,338,657

[45] Jul. 6, 1982

[54] HIGH-VOLTAGE TRANSFORMER-RECTIFIER DEVICE

[76] Inventors: Vladimir N. Lisin, Dushinskaya ulitsa, 14, kv. 106; Mikhail V. Pavlov, ulitsa Flotskaya, 13, korpus 5, kv. 77; Jury V. Laschenov, ulitsa Perovskaya, 15, kv. 41; Stanislav I. Gusev, ulitsa akademika Skryabina, 28, korpus 2, kv. 87; Lev V. Kozlov, Bolshoi Simonovsky proezd, 28, kv. 40; Sergei V. Pokrovsky, Tarutinskaya utitsa, 5, korpus 3, kv. 73; Igor I. Mozhaev, Krasnokazarmennaya ulitsa, 12, korpus 2, kv. 28, all of, Moscow, U.S.S.R.

[21] Appl. No.: 195,426

[22] PCT Filed: Jul. 2, 1979

[86] PCT No.: PCT/SU79/00046

§ 371 Date: May 8, 1980

§ 102(e) Date: May 7, 1980

[87] PCT Pub. No.: WO80/00636

PCT Pub. Date: Apr. 3, 1980

[30] Foreign Application Priority Data

May 21, 1974 [SU] U.S.S.R. ..... 2026801
Sep. 8, 1978 [SU] U.S.S.R. ..... 2662933

[51] Int. Cl.[3] ..... H01F 27/24; H01F 27/36; H01F 33/00

[52] U.S. Cl. ..... 363/68; 336/5; 336/84 C; 336/175; 336/211

[58] Field of Search ..... 336/5, 12, 84 C, 170, 336/175, 211; 363/68, 125, 126

[56] References Cited

U.S. PATENT DOCUMENTS

| | | | |
|---|---|---|---|
| 3,398,348 | 8/1968 | Kilgore et al. | 336/84 C |
| 3,524,126 | 8/1970 | Hartmann | 323/359 |

FOREIGN PATENT DOCUMENTS

| | | | |
|---|---|---|---|
| 7712024 | 6/1979 | Sweden | 363/68 |
| 471447 | 5/1969 | Switzerland . | |
| 224712 | 11/1968 | U.S.S.R. | |
| 500719 | 12/1976 | U.S.S.R. | |
| 601678 | 4/1978 | U.S.S.R. | 363/68 |
| 614469 | 7/1978 | U.S.S.R. | 363/126 |

*Primary Examiner*—A. D. Pellinen
*Attorney, Agent, or Firm*—Fleit and Jacobson

[57] ABSTRACT

A high-voltage transformer-rectifier device comprising a step-up three-phase transformer with a spatial magnetic circuit made up of three vertical stacks (7) of closed cores (9) insulated from one another and secured in an insulating frame (8), having a common window and carrying the sections (10) of a secondary winding (2). A primary winding (1) comprises three flat rectangular coils (11) whose vertical parts are arranged to lie pairwise along the axis of the common window in each stack (7) of the cores (9). A bridge rectifier section comprises individual bridge rectifiers connected to the sections (10) of the secondary winding (2), and each of the potential screens is formed by ring sections (6 and 20) arranged one on top of another along the stacks (7) of the cores (9).

7 Claims, 4 Drawing Figures

HIGH-VOLTAGE TRANSFORMER-RECTIFIER DEVICE

TECHNICAL FIELD

This invention relates to the generation of high d.c. voltages, more particularly, to a high-voltage transformer-rectifier device.

BACKGROUND ART

Hitherto, a transformer-rectifier device to power an electron-beam device has been a coaxial system comprising an accelerating tube, a sectionalized secondary winding, a sectionalized magnetic circuit, and a primary winding contained within a single metal enclosure. The main magnetic flux indiced by the primary winding partly links the non-magnetic elements of the device and induces in each secondary-winding section an a.c. voltage which is converted to a d.c. voltage by the builtin accelerating tube.

In said transformer-rectifier device, the magnetizing current has a direct component, and the magnetic flux has its path through the nonferromagnetic space of the accelerating tube.

This calls for a power supply of an increased installed capacity and impairs the reliability and service life of the accelerator because the power supply and the electron acceleration section are not isolated from each other under abnormal conditions either physically or electrically.

Another approach has been a high-voltage transformer-rectifier device intended to feed a direct-acting electron accelerator (cf. see USSR Inventor's Certificate No. 500,719, Class H05H5:00, of Oct. 25, 1976, Specialized Design Bureau of the Institute for High Temperatures, USSR Academy of Sciences, Bulletin No. 39, Column 2).

Said device comprises a step-up three-phase transformer with a spatially symmetric magnetic circuit carrying a primary winding and a sectionalized secondary winding.

In said device, rectifier units forming a bridge rectifier are placed parallel to the symmetry axis of the magnetic circuit. One pole of the bridge rectifier is grounded and the other is connected to a potential screen. The neutral point of the high-voltage secondary winding is likewise connected to a potential screen of its own which is insulated from the grounded lower yoke of the magnetic circuit by a support insulator.

The high-voltage terminal of the device is connected to the potential screen of the bridge rectifier pole and is arranged coaxially with the magnetic circuit. An accelerating tube combined with said terminal is installed in the same container as the transformer-rectifier device, filled with sulphur fluoride ($SF_6$) gas.

In said device, however, the insulation has to withstand unfavourable service conditions due to the off-optimal electric field structure in the effective volume, a high reactance, and a low power factor at an output voltage of several hundred kilovolts.

Thus, the insulation of the device in the direction of its symmetry axis must additionally be designed (like the axial insulation of the secondary winding) to carry the voltage between the secondary-winding neutral and the grounded magnetic circuit, and also twice the full rectified voltage. This impairs the reliability of the high-voltage transformer-rectifier device under likely over-voltages in the system and also under normal service conditions.

In said device, the insulation of the sectionalized phase secondary windings must be designed to withstand the full line voltage because the windings are connected to the rectifier units which are the full arms of the three-phase bridge rectifier. This complicates the radial structure of the electric field in the effective volume of the device. The breakdown of one of the secondary-winding sections constitutes an abnormal condition for the entire device because the magnetic flux is expelled from the spatial magnetic circuit leg common to all the second-ary-winding sections.

Since the insulation between the secondary winding of the step-up transformer and the magnetic circuit is designed to withstand the full voltage, it forms a large leakage channel for the magnetic field, so the reactance and, as a consequence, voltage losses during the commutation intervals of the rectifier units are increased. Practically, the leakage inductance of the transformer is 15% to 20%. This impairs the electrical performance of the device because the external (load) characteristic becomes drooping, and the converter draws a considerable rectifier power due to the increased commutation angle of the rectifier units. Because the high-voltage transformer-rectifier device and the accelerating tube are combined into a single unit and the power supply and the load are not isolated from each other during an abnormal condition, the reliability of the device is impaired and its service life in continuous duty is cut down. The breakdown of, or damage to, any element of the power supply or the accelerating tube calls for dismantling the entire accelerator.

DISCLOSURE OF THE INVENTION

The object of the present invention is to create a high-voltage transformer-rectifier device in which a new embodiment of the magnetic circuit, the associated windings and potential screens, and a new circuit configuration for the rectifier section would enhance the reliability of the main insulation, increase the specific volume capacity, improve the electrical performance, that is the reactance and the power factor of the high-voltage transformer-rectifier device intended to feed an electron-beam device, reduce the weight and size of the electron-gun high-voltage power supply, and make a compact and reliable high-voltage power supply having a flat external (load) characteristic and a high efficiency.

There is provided a high-voltage transformer-rectifier device comprising a step-up three-phase transformer with a spatial magnetic circuit carrying a primary winding and a sectionalized secondary winding connected to bridge rectifier units having one pole grounded and arranged parallel to the symmetry axis of the magnetic circuit, a potential screen for the secondary-winding neutral and a rectifier-unit potential screen electrically connected to a high-voltage terminal arranged coaxially with the magnetic circuit, in which, according to the invention, the spatial magnetic circuit comprises three vertical stacks of closed cores insulated from one another and secured in an insulating core frame having a common window and carrying the secondary-winding sections, the primary winding is made up of three flat rectangular coils whose vertical parts are arranged to lie pairwise along the axis of the common window in each core stack, the bridge rectifier section comprises three separate bridge rectifiers connected to the cores of secondary-winding sections, and each of the potential screens is formed by ring sections arranged one on top of another along the core stacks.

It is preferable that the device should be furnished with conductive grounded screens made as cylinders split along the generatrix and enclosing the vertical parts of the primary-winding coils arranged pairwise in said cylinders.

It is also advantageous that the core bobbin should be made as a prism having three concave faces formed by segments of dielectric cylinders with transverse slots for the ring cores carrying the secondary-winding sections, said cores being secured in the slots by insulating posts.

It is further advantageous that the high-voltage terminal should be built as an unbraided cable arranged coaxially with the magnetic circuit, and that the rectifier-unit potential screen sections should be placed concentrically with the cable on its surface.

It is also preferable that the sections of the potential screen for the secondary-winding neutral should be made of profiled conductive rings enclosing all the three core stacks.

BEST MODE OF CARRYING OUT THE INVENTION

Figure 1:
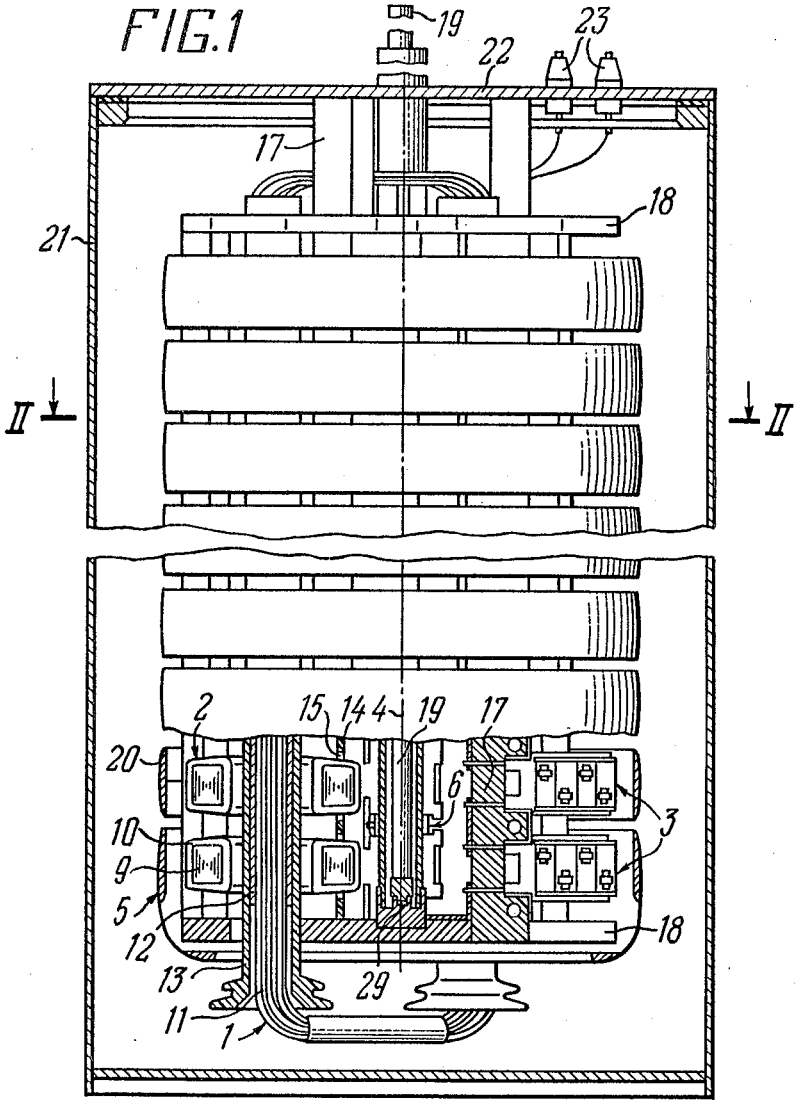
FIG. 1 is the front elevation with a cut-away view along the symmetry axis of the magnetic circuit of the high-voltage transformer-rectifier device according to the invention.

A high-voltage transformer-rectifier device comprises a step-up three-phase transformer with a spatial magnetic circuit carrying a three-coil multi-turn primary transformer winding 1 (FIG. 1) and a sectionalized secondary transformer winding 2 to which are connected bridge rectifier units 3 placed parallel to the symmetry axis 4 of the magnetic circuit.

The device has a potential screen 5 for the neutral of the secondary winding 2 and a potential screen made up of insulated ring sections 6, for the bridge rectifier units 3.

The spatial magnetic circuit comprises three vertical stacks 7 (FIG. 2) of closed toroidal cores 9 (FIG. 1) insulated from one another and secured in an insulating bobbin 8, carrying sections 10 of the secondary winding 2 and having a common window.

The primary winding 1 comprises three flat rectangular coils 11 (FIG. 3) whose vertical parts are arranged pairwise along the axis of the common window in each stack 7 of the cores 9.

The vertical parts of each of the two coils 11 of the primary winding 1 are built into a conductive grounded electrostatic screen 12 made in the form of a cylinder split along the generatrix and enclosing said vertical parts of the coils 11 of the primary winding 1.

Each electrostatic screen 12 is insulated by a film 13.

The insulating frame 8 (FIG. 2) is in the form of a prism having three concave faces formed by dielectric-cylinder segments 14 with transverse slots 15 (FIG. 1) for the toroidal cores 9 carrying the sections 10 of the secondary winding 2, secured in the slots 15 by insulating posts 16 (FIG. 2) installed together with main insulating posts 17 in profiled insulating plates 18.

Figure 3:
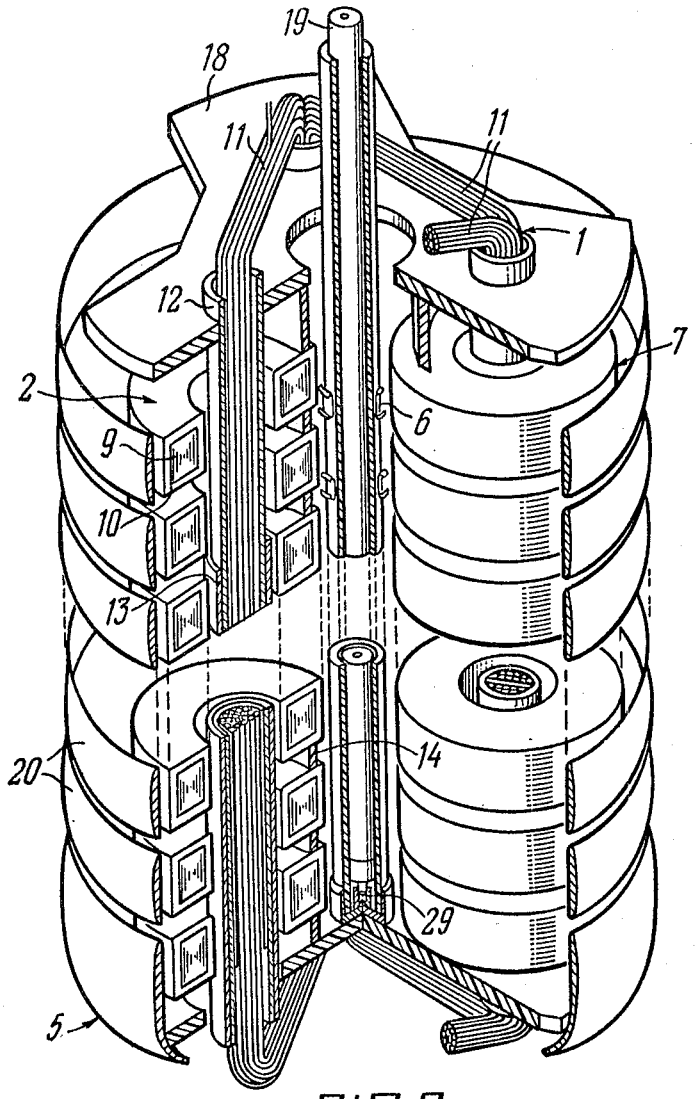
FIG. 3 is an axonometric view of the high-voltage transformer-rectifier device according to the invention, partially cut along the symmetry axis of the magnetic circuit.

The high-voltage terminal of the device, arranged along the magnetic-circuit symmetry axis 4 (FIG. 1), is formed by an unbraided cable 19, with the sections 6 of the potential screen for the bridge rectifier units 3 being arranged concentrically with the cable 19 and disposed on its surface one on top of another along the height of the stacks 7 (FIG. 3).

The potential screen 5 for the neutral of the secondary winding 2 is made up of insulated ring sections 20 (profiled conductive rings) disposed one on top of another along the height of the stacks 7 and enclosing all the three stacks 7.

The air-tight conductive enclosure 21 (FIG. 1) of the device, having a metal cover 22 with bushings 23, is filled with a gaseous or liquid dielectric acting as coolant.

The bridge rectifier units 3 (FIG. 4) are composed of individual bridge rectifiers 24 each containing six arms 25.

The junction 26 of the respective arms 25 of each bridge rectifier 24 is connected to the start of the corresponding section 10 of the secondary winding 2.

The terminals of the three star-connected sections 10 of the secondary winding 2 are connected to the corresponding ring section 20 of the potential screen 5 for the neutral of the secondary winding 2.

The centre taps of the sections 10 are conductively connected to the respective cores 9.

The positive pole 27 of the first (upper) bridge rectifier 24 is grounded and the negative pole 28 of the last (lower) bridge rectifier 24 is electrically connected via a connector 29 to the cable 19.

The intermediate poles 30 of the bridge rectifier section are conductively connected to the respective sections 6 of the potential screen for the bridge rectifier units 3, said sections being electrically connected to the cable 19.

The high-voltage transformer-rectifier device operates as follows.

When the primary transformer winding 1 is connected to the supply mains, the coils 11 are traversed by a current which magnetizes the spatially symmetric magnetic circuit.

The magnetic flux is concentrated in the individual toroidal cores 9 and induces a three-phase system of emfs in the sections 10 of the secondary winding 2.

Figure 2:
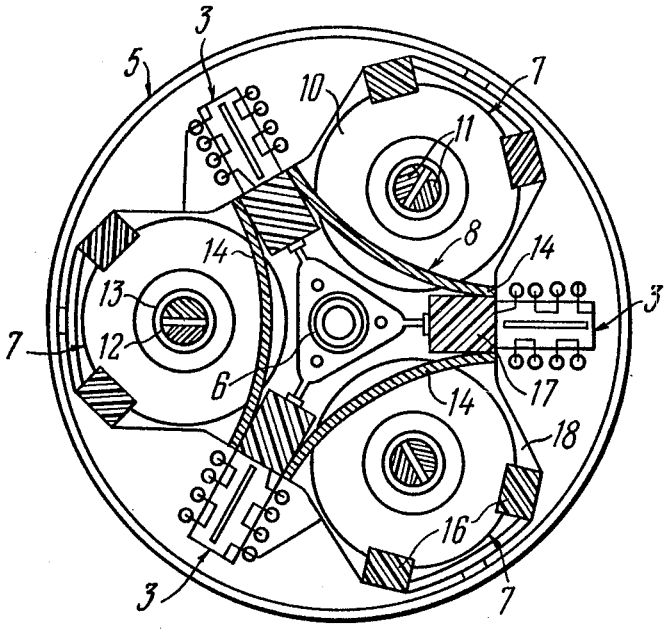
FIG. 2 is the section along line II—II as shown in FIG. 1 of the high-voltage transformer-rectifier device according to the invention.

The sections 20 of the screen 5, enclosing all the three stacks 7 of the cores 9, equalize the voltage gradients between the individual sections 10 of the winding 2 and also between the magnetic circuit and the conductive enclosure 21 (FIG. 1).

In this way, it is secured that the potential of the sectionalized screen 5 increases stepwise from top to bottom along the stack 7 of the cores 9 (FIG. 3).

Figure 4:
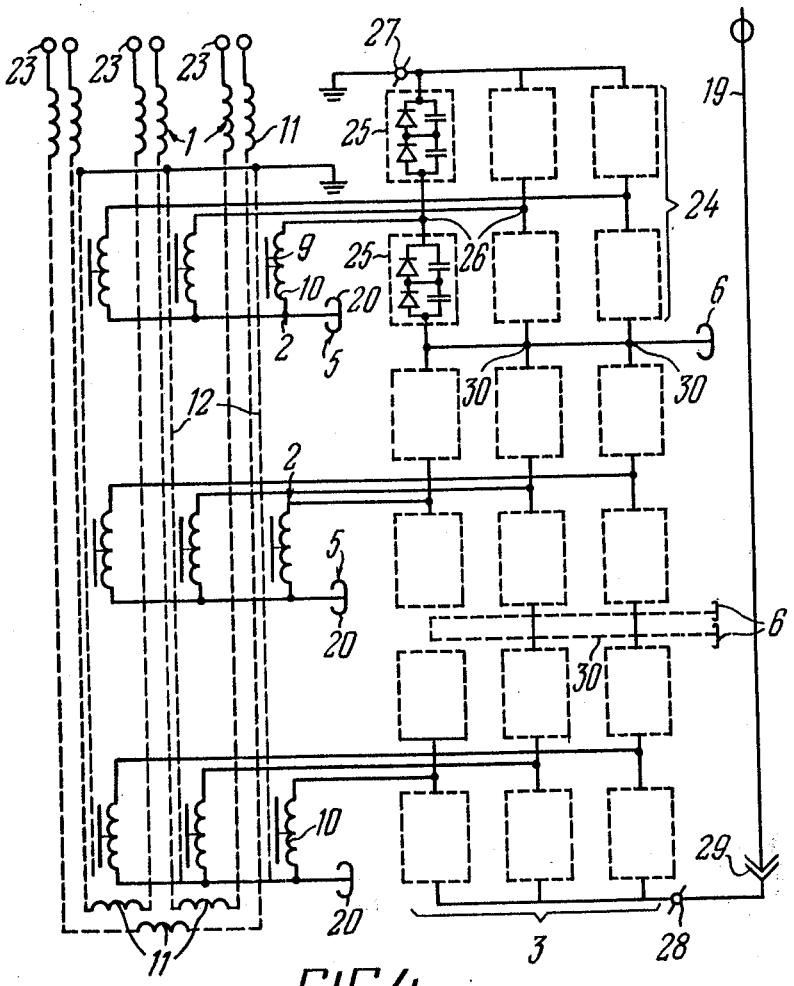
FIG. 4 is the connection diagram of the rectifier units of the high-voltage transformer-rectifier device and the other elements of said device, according to the invention.

The alternating three-phase voltage taken at the junctions 26 (FIG. 4) between the sections 10 of the secondary winding 2 is rectified by the cascade rectifier section made up of the rectifier units 3 assembled from the three-phase bridge rectifiers 24. Along the symmetry axis 4 (FIG. 1) of the magnetic circuit, the high d.c. voltages increases stepwise from the upper bridge rectifier 24 (FIG. 4) with the grounded pole 27, towards the lower bridge rectifier 24 whose pole 28 is connected to the cable 19. At the same time, the line voltage between the elements of the vertical stacks 7 (FIG. 3) of the spatial structure does not exceed the rectified voltage of one stage, which is 1/n of the output voltage. Owing to the concentration of the magnetic fluxes in the individual toroidal cores 9, the system ensures controlled division of the rectified voltage among the individual bridge rectifiers 24 (FIG. 4). The power is coupled out of the device along the entire length of the cable 19 connected to the lower high-voltage pole 28, whereas the intermediate poles 30 conductively connected to the sections 6 ensure uniform potential distribution over the surface of the insulation of the cable 19.

Under nominal service conditions, the leakage magnetic fields in the device are minimal, the external (load) characteristic is flat, and the output d.c. voltage depends little on the load current. The large surface area of the spatial magnetic circuit ensures good heat abstraction from the sections 10 of the secondary winding 2 and from the cores 9.

In the case of a breakdown in the load (an electron gun), the grounded screen 12 for the primary winding 11 will ensure a reliable capacitive isolation from the supply mains during fast transients on the side of the high-voltage winding 2, which is a good protection for the primary controller of the device.

If a reversible breakdown occurs in one of the section 10, the high-voltage transformer device will deliver a constant voltage at the output. This is because the magnetic flux is forced out of the toroidal cores 9 of only one stage, and the magnetic induction in the remaining cores 9 increases in proportion. Thus, an inadvertent short-time short-circuit in one of the sections 10 of the secondary winding 2 will not constitute an abnormal condition for the device as a whole.

The instant high-voltage transformer-rectifier device has the following advantages. Because the magnetic circuit is made up of the ring (toroidal) cores 9, this keeps the length of the magnetic lines of force to a minimum and reduces the reactive current under no-load conditions to less than 5%. Within each magnetic-circuit member, the magnetic flux always links in the direction of rolling of the sheet or strip material. The large surface area of the insulated cores 9 ensures good heat abstraction in a gaseous or liquid dielectric. Also, each core 9 is at the centre-tap potential of the respective section 10 of the secondary winding 2, so the insulation between the secondary winding 2 and the core 9 may be designed to carry only half the voltage per stage, which is ½n of the output voltage.

The insulating frame 8 (FIG. 2) comprising the dielectric (say, glass-epoxy) cylinder segments 14 with the transverse slots 15 (FIG. 1) is intended to secure the cores 9 in position. The insulating frame 8 (FIG. 2) is a regular prism with concave faces, and serves to separate the mechanical and the insulating structures of the spatial magnetic circuit. Said frame 8 carries the mechanical load and, at the same time, provides a maximum contact area between the cores 9 and the coolant (sulphur fluoride or transformer oil).

The main insulation of the spatial magnetic circuit is constituted by the insulation of the coaxial system formed by the grounded screen 12 (FIG. 3) of the primary winding 1, enclosing pairwise the vertical parts of the primary coil 11, and the system of the toroidal cores 9 carrying the sections 10 of the secondary winding 2. Such an insulation is easy to calculate and make, for example, in the form of a paper-film cylinder immersed in a liquid dielectric, or in the form of a purely oil duct.

The ring sections 20 of the conductive potential screen 5 concentrically enclosing all the stacks 7 of the cores 9 serve to create a uniform electric field structure in the radial direction, and also to equalize stepwise the electric field gradient of the transformer-rectifier device in the axial direction. Here, the section having a maximum potential is located at the bottom of the device.

Because the toroidal sections 10 of the secondary winding 2 energize the bridge rectifiers 24 (FIG. 4) whose arms 25 form a symmetric spatial system, this ensures, firstly, controlled division of the potential along the rectifier unit 3, and, secondly, the optimal utilization of the effective volume.

Power is coupled out of the device by means of the high-voltage terminal arranged along the symmetry axis 4 (FIG. 1) of the spatial magnetic circuit and made in the form of an unbraided high-voltage cable 19 (FIG. 3) surrounded by conductive rings (the sections 6) spaced apart an equal distance corresponding to the insulating gap between the cores 9.

This maintains the uniform axial structure of the electric field, and power is taken off the entire surface of the high-voltage terminal.

As compared with a prior-art device in which the axial structure of the electric field extends through the insulation between the neutral and a grounded screen magnetic circuit, the insulation between the magnetic circuit and a high-voltage polescreen, and the insulation between the pole and an enclosure, the present device is designed in the axial direction only to withstand the interpole voltage of the rectifier units 3 (FIG. 4), which fact improves the reliability of the entire system.

Since, owing to its geometrical position, the primary winding 1 insures the magnetic flux within the ferromagnetic material of the cores 9, the leakage field and the leakage inductance are very small, being practically below 3%.

The external (load) characteristic of the device is flat, the voltage drop during the commutation intervals of the rectifier is minimum, and the reactive power consumption is also minimal.

Because in the instant device the secondary winding 2, the rectifier units 3 and the potential screens are sectionalized, the insulation need not be designed to carry the full line voltage. Practically, the radial insulating gap between the stacks 7 (FIG. 3) of the cores 9, carrying the sections 10, depends on the line voltage per stage, which is 1/n of the full line voltage of the device.

INDUSTRIAL APPLICABILITY

This invention can be applied to power various electrophysical devices, in particular, to feed electron-beam devices used for electron-beam welding, soldering and cutting of metals and for pumping high-power ion lasers.

We claim:

1. A high-voltage transformer-rectifier device comprising:

a step-up three-phase transformer with a spatial magnetic circuit having a symmetry axis and carrying a primary winding and a sectionalized secondary winding having a secondary-winding neutral and a plurality of sections;

bridge rectifier units coupled to said sectionalized secondary winding and having one pole grounded and arranged parallel to the symmetry axis of the magnetic circuit;

a potential screen for the secondary-winding neutral;

a high-voltage terminal arranged along the symmetry axis of the magnetic circuit; and a rectifier-unit potential screen electrically connected to the high-voltage terminal;

wherein the spatial magnetic circuit comprises an insulating frame, and three vertical stacks of closed cores insulated from one another and secured in said insulating frame, said cores having a common window with an axis and carrying sections of the secondary winding, the primary winding comprising three flat rectangular coils having vertical parts arranged to lie pair-wise along the axis of the common window in each stack of the cores, and wherein the bridge rectifier units each comprise individual bridge rectifiers connected to the sections of the secondary winding, and each of the potential screens comprises ring sections arranged one on top of another along the stacks of the cores.

2. A device as claimed in claim 1, further comprising conductive grounded screens made as cylinders split along a generatrix thereof, and enclosing the vertical parts of the coils of the primary winding, arranged pair-wise in said cylinders.

3. A device as claimed in any one of claims 1 or 2, further comprising an insulating frame for the closed cores, and a prism having three concave faces made up of dielectric cylinder segments having transverse slots for the closed cores carrying the sections of the secondary winding, said closed cores being secured in the transverse slots by insulating posts.

4. A device as claimed in any one of claims 1 or 2, wherein the high-voltage terminal comprises an unbraided cable arranged along the symmetry axis of the magnetic circuit, and wherein the rectifier-unit potential screen comprises sections which have a surface and which are installed concentrically with respect to the unbraided cable of said surface.

5. A device as claimed in any one of claims 1 or 2, wherein the sections of the potential screen for the secondary-winding neutral comprise conducting rings ensclosing all three vertical stacks of the closed cores.

6. A device as claimed in claim 3, wherein the high-voltage terminal comprises an unbraided cable arranged along the symmetry axis of the magnetic circuit, and wherein the rectifier-unit potential screen comprises sections which have a surface and which are installed concentrically with respect to the unbraided cable of said surface.

7. A device as claimed in claim 3, wherein the sections of the potential screen for the secondary-winding neutral comprise profiled rings enclosing all three vertical stacks of the closed cores.

* * * * *